US007520838B1

(12) United States Patent
Sudeith et al.

(10) Patent No.: US 7,520,838 B1
(45) Date of Patent: Apr. 21, 2009

(54) CLIMBING WALL ROUTE SETTING ASSEMBLY AND PROCESS

(75) Inventors: Timothy S. Sudeith, Edina, MN (US); Jeremy Mariette, Crystal, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 0 days.

(21) Appl. No.: 11/280,900

(22) Filed: Nov. 16, 2005

Related U.S. Application Data

(60) Provisional application No. 60/628,458, filed on Nov. 16, 2004.

(51) Int. Cl.
*A63B 9/00* (2006.01)

(52) U.S. Cl. ..... 482/37; 482/35; 482/36

(58) Field of Classification Search ..... 482/35–37; 434/247, 255; 273/440, 441, 445, 446; 52/33, 52/174

See application file for complete search history.

(56) References Cited

U.S. PATENT DOCUMENTS 5,254,058 A 10/1993 Savigny
5,732,954 A 3/1998 Strickler et al.
5,944,634 A * 8/1999 Neves ..... 482/37
6,074,321 A * 6/2000 Maeda et al. ..... 472/221
6,074,327 A 6/2000 Franklin
6,231,482 B1 * 5/2001 Thompson ..... 482/37
6,540,645 B1 * 4/2003 Zeilinger ..... 482/35
6,551,216 B2 * 4/2003 Rennex ..... 482/35
7,056,266 B2 * 6/2006 Sudeith ..... 482/37
2005/0245355 A1 * 11/2005 Brewer et al. ..... 482/37

* cited by examiner

*Primary Examiner*—Loan H Thanh
*Assistant Examiner*—Allana Lewin
(74) *Attorney, Agent, or Firm*—Anthony G. Eggink; Katrina M. Eggink

(57) ABSTRACT

A climbing wall route setting assembly and process for setting climbing wall routes. The route setting assembly includes a guide with climbing wall maps having a coordinate system. Cooperating sets of hand hold structures are provided with indicia to create climbing routes of varying difficulty utilizing the route maps.

19 Claims, 4 Drawing Sheets

CLIMBING WALL ROUTE SETTING ASSEMBLY AND PROCESS

This application claims the benefit of U.S. Provisional Patent Application Ser. No. 60/628,458, filed on or about Nov. 16, 2004.

BACKGROUND OF THE INVENTION

The present invention relates generally to a climbing wall route setting assembly and a process for planning and setting the hand holds for climbing routes on climbing wall structures. Particularly, the invention relates to a climbing route setting guide having route maps to set climbing routes with identifiable hand holds on an associated climbing wall structure.

Artificial climbing and bouldering walls are increasingly used due to physical fitness awareness and interest in the climbing and bouldering sports. Climbing wall assemblies are also provided to introduce children to the climbing sports in a safe, convenient and educational manner. Various devices have also been introduced to make climbing for children a fun and educational experience. Exemplary climbing wall assemblies and devices are disclosed in Applicant's pending U.S. patent application, entitled Climbing Wall Assembly, having Ser. No. 10/236,728, filed on Sep. 6, 2002, in pending patent application entitled Safety Mat Securement Assembly having Ser. No. 11/061,583 filed on Feb. 18, 2005, and in pending patent application entitled Climbing Wall Assembly having Ser. No. 11/247,497 filed on Oct. 1, 2005, the teachings of said Applications being fully incorporated by reference herein.

Indoor and outdoor climbing walls typically have a plurality of hand holds positioned thereon to provide the climber one or more climbing paths or routes. It has been found beneficial, therefore, to provide climbing wall structures with means that allow the hand holds to be repositioned on the climbing wall surface. Preferably, hand hold mounting structures are provided in the climbing wall that permit relatively quick and easy mounting, removal and remounting of the hand holds with respect to the climbing wall surface. Further, the planned and definitive positioning of the hand holds on the climbing wall surface and with respect to each other is desirable for providing a preconceived climbing route.

There is a need in the climbing art to provide an assembly and process to create planned climbing routes for indoor and outdoor climbing wall structures. To keep climbers interested and challenged, the hand holds on a climbing wall are arranged and may be periodically changed to create climbing routes with different physical and educational challenges. The route setting assembly, which includes a climbing wall structure, route maps and cooperating labeled hand hold devices, provides organized, effective and planned methods of arranging the hand holds on a specified wall surface to create various climbing routes.

SUMMARY OF THE INVENTION

The present invention comprises a climbing wall route setting assembly and a planning and guide process for setting various hand hold patterns to create climbing routes on associated climbing wall panels.

The route setting guide and processes of the present invention are for use with hand holds and climbing walls of a climbing wall assembly, such as those set forth in application Ser. Nos. 10/236,728, 11/061,583 and 11/247,497, referenced above, for example. The hand holds of the invention are route-setting hand hold structures which have identifiable features and markings which relate to the complexity of climbing level and its predetermined position on the wall surface to create the climbing route. For example, the color of the hand hold body may indicate its difficulty of use and thus the route difficulty, i.e. green for beginner and which is relatively easy, yellow for intermediate difficulty and red for advanced climbers and relatively difficult. The hand holds are preferably provided in handhold sets, identified in the route setting guide and which are arranged by degree of difficulty. Each hand hold is preferably marked with a label or indicia, which may include a letter, a number and a directional arrow, for example. The number and letter may further identify the hand hold as a particular hand hold from a specified hand hold set.

The route setting guide depicts a plurality of climbing wall maps with specified climbing routes. A climbing wall structure is represented by means of a designated wall pattern grid or coordinate system. Hand hold mounting positions are shown at the interstices of the grid pattern. Corresponding indicia on the hand holds are used to mount hand holds at these predetermined hand hold mounting positions to form a specified climbing route as depicted on the map. The user obtains the handhold with the specified indicia and uses the coordinate system to mount the hand hold in the proper position on the climbing wall. An arrow may be included in the indicia to indicate the orientation of the hand hold with respect to a designated grid so that the handhold depicted in the route setting guide is similarly oriented on the climbing wall.

On the climbing wall, each hand hold mounting position is preferably an aperture in the wall having a T-nut positioned therein. A bolt member is preferably utilized extending through the hand hold body and threaded into the T-nut to secure the hand hold to the climbing wall. The handholds of the present invention are preferably constructed of a molded polyurethane and the indicia are preferably molded into the hand hold body, however, other hand hold body structures and identifiable indicia by means of markings, labels and the like may be utilized within the purview of the invention.

It is an advantage of the present invention to provide an easy to use route setting guide for arranging hand holds on a climbing wall to create selected climbing routes of varying difficulties. It is another advantage of the present invention to provide hand holds in sets having specific characteristics, of size, color and shape, for example, so that varying degrees of difficulty can be easily identified. It is a further benefit of the present invention to provide hand holds with indicia thereon for ease of identification and proper placement on a climbing wall to create climbing routes.

These and other advantages of this invention will become clear from the following description by reference to the drawings.

DESCRIPTION OF THE PREFERRED EMBODIMENTS

The climbing wall route setting assembly of the invention comprises a route setting guide having climbing wall maps, a corresponding climbing wall structure and labeled route-setting hand holds. The route setting guide permits the user to position hand holds in a predetermined pattern onto a climbing wall structure, i.e., a wall panel, a plurality of wall panels or other wall structure having a pattern of hand hold mounting means. Hand holds are provided in sets and labeled with indicia having numbers, letters and arrows, for example, to guide the user, with instructional steps from the guide, in the route setting process. The climbing routes can be set to varying climbing difficulties using the maps illustrated in the guide.

A climbing wall structure may be formed by a plurality of climbing wall panels placed adjacent each other and having hand holds mounted and secured to the panels. A route setting guide is provided by the present invention and which includes maps, each map depicting a climbing wall panel showing a specified pattern of hand holds to define a climbing route. Thus, a plurality of wall panel maps correspond to specified climbing routes for setting the hand holds on the climbing wall structure.

A climbing wall structure and a plurality of route-setting hand hold sets are further utilized in the present invention. Each hand hold set has a plurality of hand hold structures which are preselected, have a predetermined size and configuration, are color coded and are labeled to thereby simplify the route setting process. The hand holds are labeled with indicia, i.e., numbers, letters and directional arrows. The labels correspond to the routes set forth in the route setting guide to aide and direct the instructor through the climbing route setting process. The route setting guide provides a plurality of maps to set climbing routes and permits the instructor to set routes of varying difficulty using the illustrated maps of the guide. The guide may further include depictions of the hand hold sets, a size scale and a color code. The maps allow climbing route difficulty levels to be set according to the difficulty level of the hand hold structure, the spacing between the hand holds, the orientation of the hand hold and the degree of problem solving required to execute the climb.

Effective route setting is very important particularly for indoor and outdoor climbing walls utilized by students. The route setting process utilizing the route setting guide and labeled hand holds permit students to continually enjoy climbing, to be challenged and for instructional goals to be pursued. To challenge the student, climbing routes are rated giving the student climbing choices and permits climbing progress to be monitored.

Figure 1:
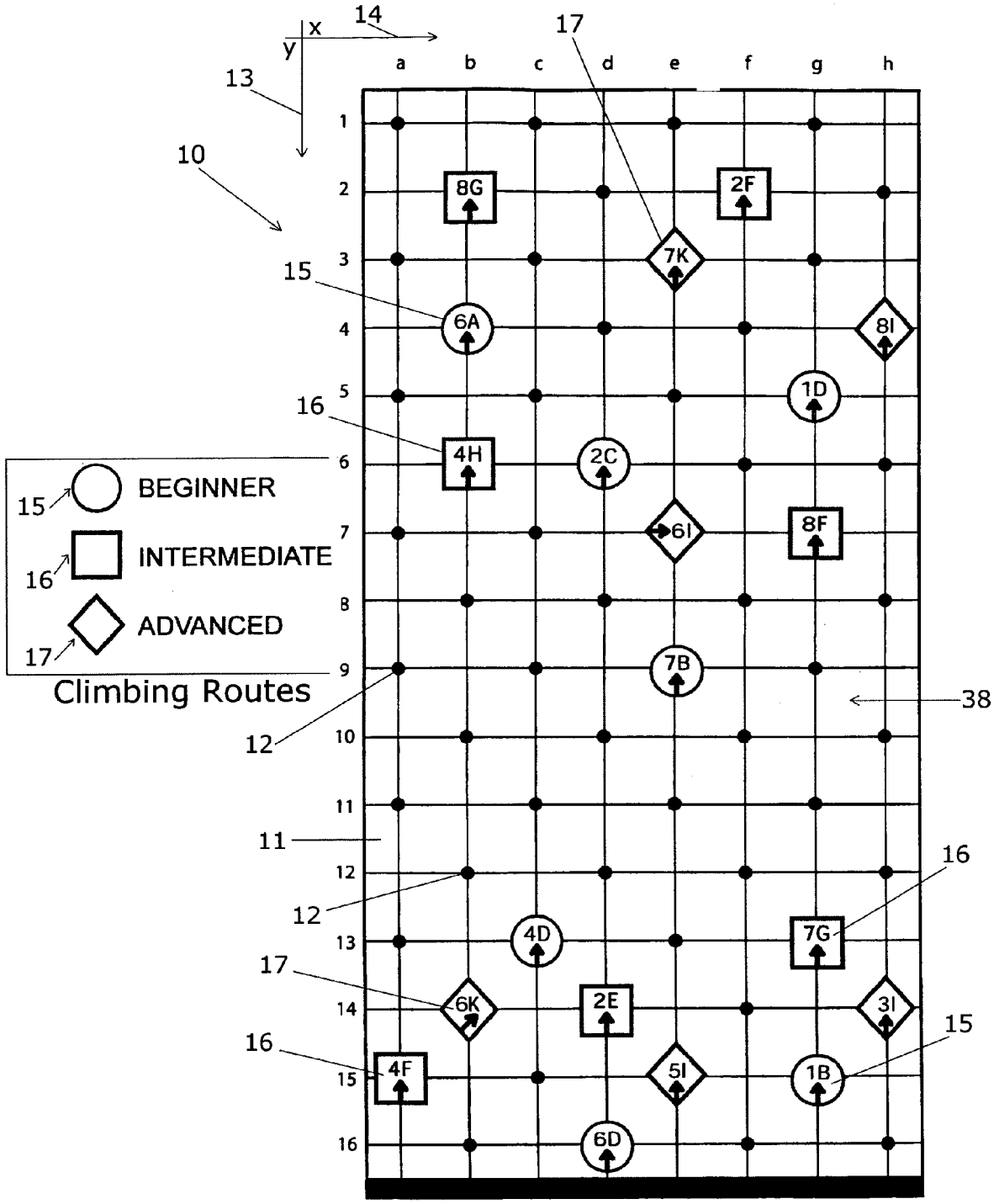
FIG. 1 is a plan view showing a route setting map of the invention used to plan various levels of difficulty for climbing routes.

Referring to FIG. 1, route setting map 10 is shown depicting a climbing wall panel 11 having grid 38 with an x, y coordinate system to identify the locations of hand hold mounting positions. The letters 'a-h' of x-axis 14 denote columns of fastening positions, while the numbers 1-16 of y-axis 13 denote rows of fastening positions. Preferably, the fastening positions in the corresponding climbing wall are embedded T-nut structures, for example. Thus, the fastening positions 12 at the interstices or intersections of the grid patterns of the route setting maps replicate the T-nut patterns of the associated climbing wall panel.

FIG. 1 shows climbing wall route map 10 depicting wall panel 11 having a grid pattern 38 consisting of intersecting horizontal and vertical lines, providing the x-, y-coordinate system. As indicated by the climbing route legend, hand holds are represented on map 10 by a circle indicia 15, square indicia 16, and diamond indicia 17 which indicate beginner, intermediate and advanced hand holds, respectively. Fastening positions 12 are shown located at specified locations as designated by x-axis 14 with coordinates a-h and y-axis 13 with coordinates 1-16. Route map 10 shows varying levels of hand holds 15 (round), 16 (square) and 17 (diamond) arranged at various fastening positions 12 thereby forming specified climbing routes. An additional route may be provided whereby climbers can utilize any level of hand hold to traverse the climbing wall. As will be discussed below with respect to the hand hold sets of FIGS. 7 and 8, the letter and number of the indicia 15-17 refer to a particular hand hold within a set of hand holds, i.e., a particular handhold from an easy, intermediate, or advanced set of hand holds.

Figure 2:
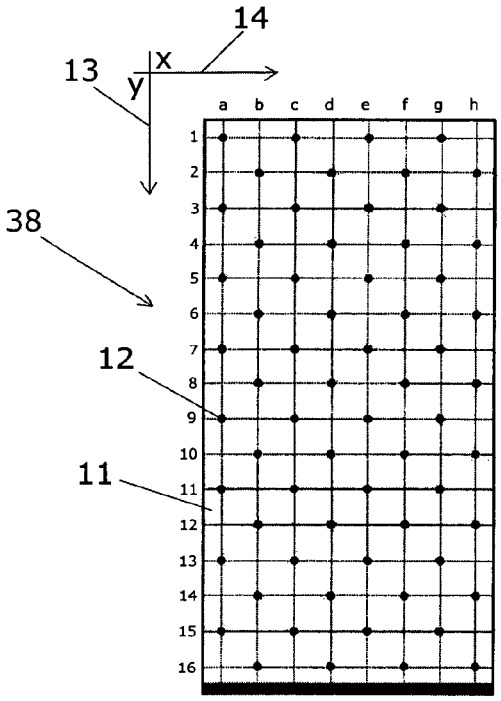
FIG. 2 is a plan view showing a coordinate system and hand hold mounting locations for the climbing wall maps of the invention.
Figure 3:
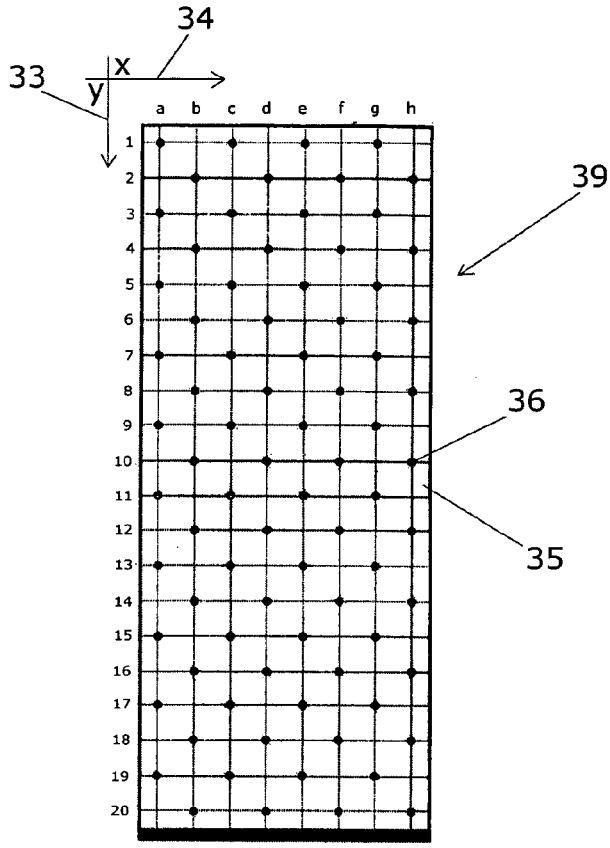
FIG. 3 is a plan view showing another coordinate system and hand hold mounting locations for the climbing wall maps of the invention.

As shown in FIGS. 2 and 3, route maps may be provided to represent and accommodate specified sizes of climbing wall panels, i.e., 4 ft.×8 ft. or 4 ft.×10 ft. panels. FIG. 2 shows a map of wall panel 11 (4 ft.×8 ft. panel) having grid pattern 38 having x-axis 14 with coordinates a-h and y-axis 13 with coordinates 1-14 to designate 64 T-nut fastening positions 12. FIG. 3 shows a map of wall panel 35 (4 ft.×10 ft. panel) having grid pattern 39 having x-axis 34 with coordinates a-h and y-axis 33 with coordinates 1-20 to designate 80 T-nut fastening positions 36.

Figure 4:
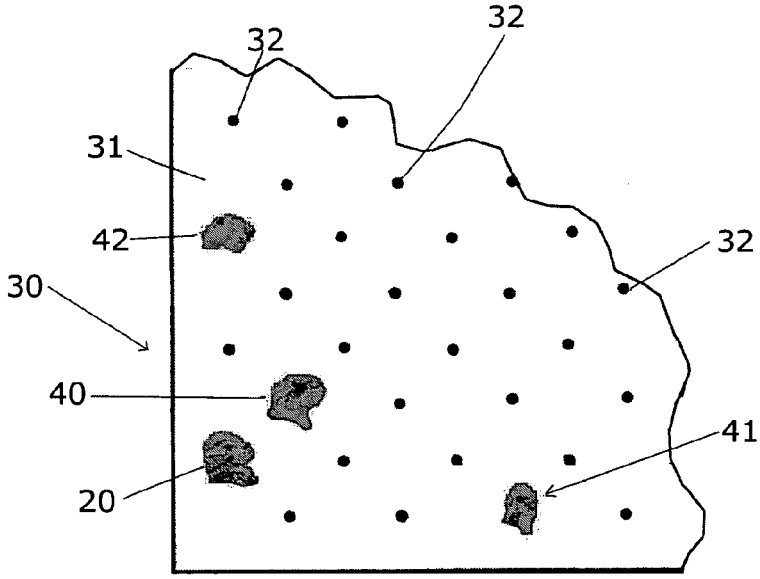
FIG. 4 is a partial plan view of a climbing wall structure showing hand holds mounted thereto.

FIG. 4 is a partial view of a climbing wall 30 showing fastening positions 32 in wall panel 31. Hand hold structures 20, 40, 41 and 42, obtained from hand holds sets 18, are shown mounted on wall panel 31. These hand hold structures are shown in FIG. 7 and further discussed below.

Figure 5:
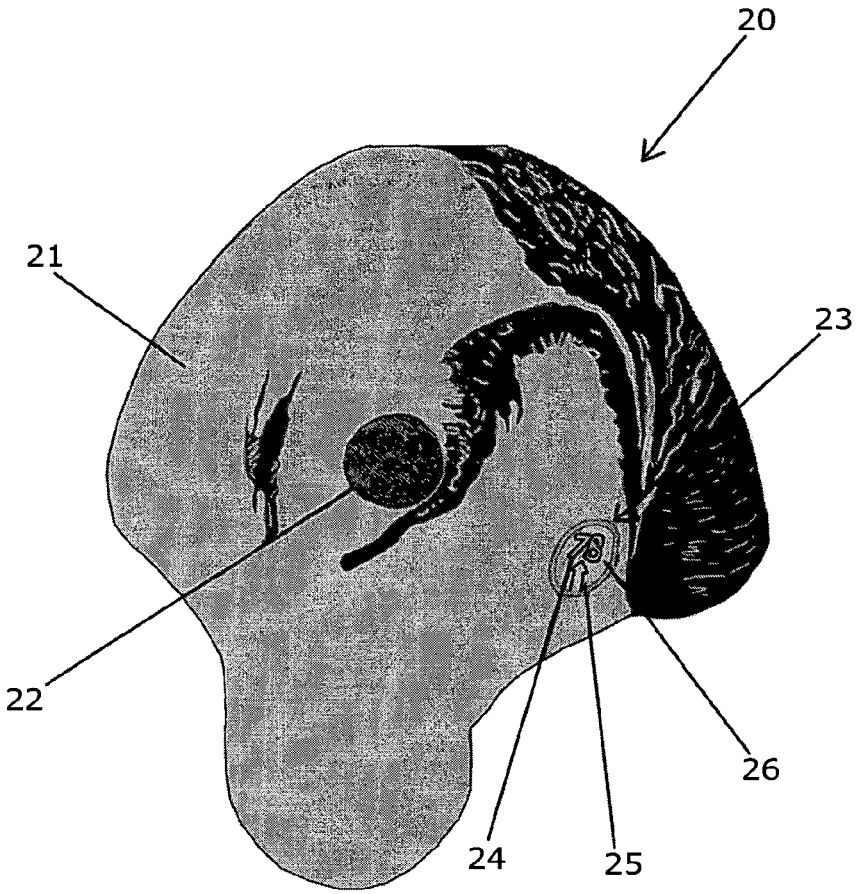
FIG. 5 is a perspective view showing a hand hold structure having route setting indicia marked thereon.
Figure 6:
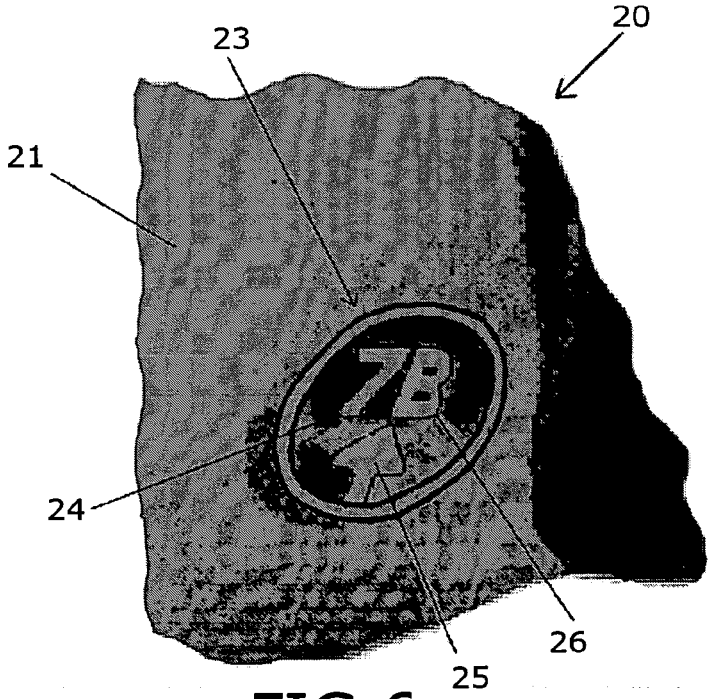
FIG. 6 is an enlarged view showing route setting indicia marked on the hand hold of FIG. 5.

As shown in FIGS. 5 and 6, hand hold structure 20 has a body 21 with a route setting indicia 23 disposed thereon, i.e., molded into body 21. Route setting indicia 23 is shown having letter indicia 26, number indicia 24 and a directional positioning arrow 25. Bore 22 is provided to receive a fastening member to mount and secure the hand hold to a climbing wall panel.

To set a route, a user of a route map first selects which route is desired for placement on the climbing wall. Each page of the route map represents one panel on a climbing wall. The route-setter next sorts through the hand hold sets and selects the holds required for the selected route by matching the labels on the route map with the label or indicia on the hand hold body. The route-setter then lays out the chosen hand holds on the floor or ground along the base of the climbing wall in the order in which they will be mounted to the wall. Then, the hand holds are mounted to the wall panels using, for example, an allen wrench and bolts which cooperate with the T-bolt fastening structures in the wall panel, and making sure that the arrow on each hand hold is oriented in the same direction as shown on the route map. For example, to match the directional arrow in the route map, the arrow on the hand hold is properly oriented on the wall panel when the hand hold body is turned or rotated before the T-bolt is tightened into the T-nut embedded in the climbing wall. Subsequent tightening of the T-bolt fastening structure the arrow on each hand hold is oriented in the same direction as shown on the route map to set the desired climbing route on the climbing wall.

Figure 7:
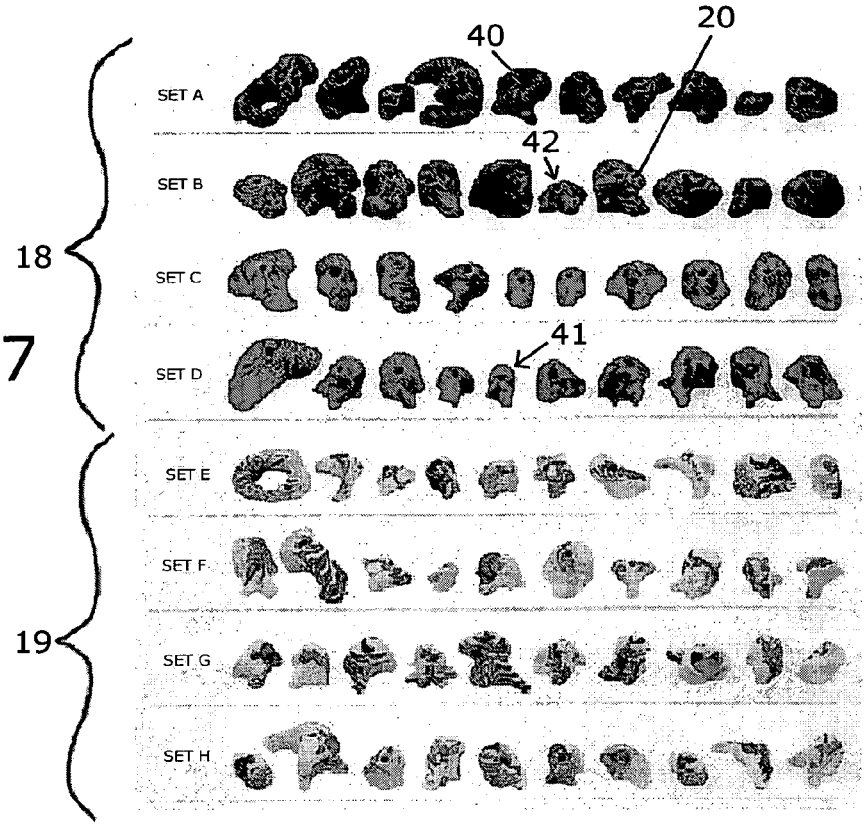
FIG. 7 is a perspective view showing hand hold sets used in the climbing route setting assembly of the invention.
Figure 8:
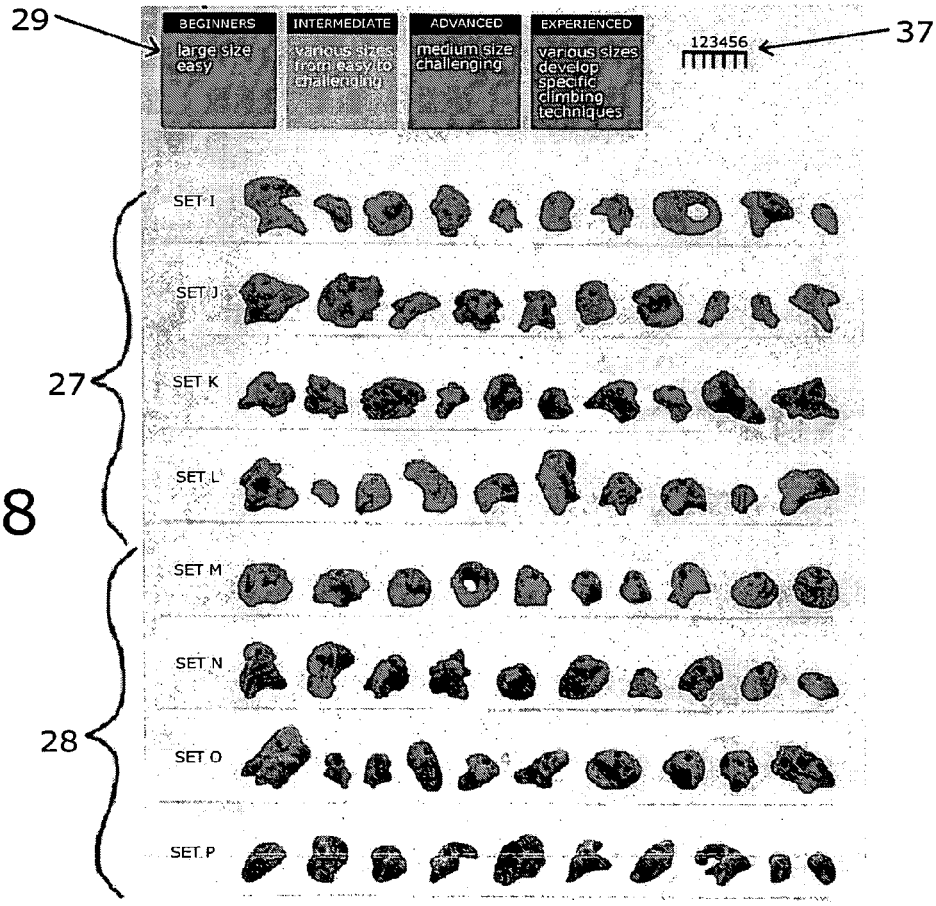
FIG. 8 is a perspective view showing a plurality of other hand hold sets.

FIGS. 7 and 8 show a plurality of route setting hand hold sets that are specifically designed, configured, color coded, labeled and used to form predetermined climbing routes. The hand hold sets include various shapes of hand holds, i.e., crimpers, slopers, pinchers, edges, pockets, jugs, etc., as used in the art. Each hand hold of the set is colored and has indicia labeled with numbers, letters and directional arrows. For example, as set forth in the legend, green hand hold sets 18 (sets A-D) are comprised of relatively large sizes which are easier to grasp for beginners. Intermediate climbers may utilize yellow hand hold sets 19 (sets E-H) comprised of various sizes ranging from easy to challenging to grip. Advanced climbers may utilize red hand hold sets 27 (sets I-L) comprised of a generally medium size and which are designated challenging to grip. Experienced climbers may be provided blue hand hold sets 28 (sets M-P) comprised of various sizes to develop specific climbing techniques. Still other climbers may utilize a rainbow color assortment of hand holds, i.e., a selection utilizing a plurality of hand hold colors. The route setting guide may further include depictions or images of the various hand hold sets and a color code 29 and scale 37 to identify hand hold difficulty level and size of the respective hand holds of the sets shown.

Referring further to FIG. 7, beginner hand hold set 18 is shown comprising sets A, B, C and D, wherein each set is shown containing 10 individual beginner hand holds. Referring to FIG. 1, fastening positions 12 and hand hold indicia 15, 16 and 17 are shown located at coordinates of x-axis 14 and y-axis 13 of grid pattern 38. For example, beginner hand hold indicia 15, having the label '6A' with a directional arrow pointing vertically upwards is shown located at x coordinate 'b' and y coordinate '4'. Thus, the sixth hand hold in Set A of FIG. 7, would be placed at position b-4 of grid pattern 38 on the climbing wall panel represented by route map 10 of FIG. 1. The hand hold would be further aligned by corresponding the direction of the label on the hand hold to the direction of the arrow shown on the route map, as discussed below with respect to FIGS. 1 and 5-6.

Referring again to FIG. 1, a climbing wall route map 10 is shown having wall panel 11 and fastening positions 12 and showing hand hold indicia 15-17 disposed thereon. As shown in FIGS. 5 and 6, each hand hold 20 is preferably constructed of a body 21 having route setting indicia or label 23 disposed thereon. Route setting label 23 is shown comprising letter indicia 26, number indicia 24 and positioning arrow 25. Bore 22 is shown for receiving a fastening member to set the hand hold to a wall panel, i.e., into a T-nut located in the wall panel. Label or indicia 23 is shown as imbedded or molded in the hand hold body, i.e., formed in the molding process, however, the label may be any other indicia, for example, a sticker, a marking on the body surface, and the like. Further, although a T-nut and corresponding bolt structure are discussed to mount a hand hold to a climbing wall panel, any other means known in the art may be utilized, for example, adhesive, screw members, nail members and like fastening means.

In use, route map 10, for example, may be used to create and change climbing wall hand hold routes. Wall panel 11 having fastening positions 12 shown in map 10 will correspond to the associated climbing wall panel on which the hand holds will be mounted, which has corresponding, predetermined fastening positions, for example, T-nut structures embedded in the climbing wall. Map 10 shows a circular beginner hand hold indicia 15, square intermediate hand hold indicia 16 and diamond hand hold indicia 17 shown at various fastening positions 12. Particularly, map 10 calls for beginner hand hold '7B' to be positioned at a fastening position corresponding to letter 'e' on the x-axis and number 9 on the y-axis and having its position arrow pointed vertically upwards. Hand hold 20, the seventh hand hold from Set B in FIG. 7, is hand hold '7B' and is further shown in FIGS. 5 and 6 having label 23 which corresponds to a hand hold indicia 15 of map 10. Positioning arrow 26 is used to properly align hand hold 20 on a climbing wall panel in the same way the arrow in indicia 15 is positioned on wall panel 11 of map 10. Thus, hand hold 20 may be properly placed and aligned or rotationally oriented on a climbing wall panel to form a climbing route as depicted in the route map. To do so, the hand hold 20 is simply moved to the corresponding x,y coordinate and then aligned or rotated about the fastening axis defined by the T-nut structures embedded in the climbing wall. This alignment is provided by means of rotating the flat bottom surface of the hand hold with respect to the climbing wall surface so that the positioning arrow 26 of hand hold 20 is aligned or oriented in the same direction that the arrow of indicia 15 of map 10 is directed.

Further it is within the purview of this invention to utilize a coordinate system on the climbing wall on which the routes are set. For example, the coordinate system of the route map may be projected onto the climbing wall structure or permanent or temporary markings may be provided on the wall structure, i.e., coordinate markings, axis provided on tape or other removable structures, to aid the route-setter in proper placement of the hand holds. Transparency, computer or other projection means may also be utilized to temporarily place the route map coordinate system on the climbing wall during the route setting process.

Although discussed with respect to climbing wall structures having wall panels mounted to existing walls, it is within the purview of this invention to utilize various climbing wall structures, for example, utilizing existing indoor or outdoor walls, a gymnasium wall or a concrete block wall, on which to directly mount hand holds. Further, although a T-nut and bolt hand hold attachment means is discussed, other hand hold attachment means known in the art may be utilized with other climbing wall structures. i.e., expandable sleeve anchor/screw combinations for concrete block walls or bolt/nut combinations that extend through the wall and like fastening systems. Referring to the indicia or label members used on the route setting maps and to designate a specific hand hold, other indicia may be used, for example, any combination of letters, numbers, geometric shapes, or other indicia. And although a rectangular (x,y) coordinate system is discussed herein, other coordinate systems may be utilized within the purview of the present invention, i.e, polar (r, θ) coordinates, cylindrical coordinates.

As many changes are possible to the embodiments of the assemblies and processes of this invention utilizing the teachings thereof, the descriptions above, and the accompanying drawings should be interpreted in the illustrative and not in the limited sense.

That which is claimed is:

1. A climbing route setting assembly comprising:

a) a route setting guide having at least one climbing route setting map with an x, y coordinate, handhold selection and hand hold orientation system and at least one climbing path, each said climbing path having a plurality of specified x, y coordinate positions and indicia for identifying hand hold selection, mounting position and orientation to form said climbing path on a climbing wall having a corresponding x,y coordinate system;

b) a rigid climbing wall having a predetermined x,y coordinate system to correspond with said x,y coordinate, hand hold selection and handhold orientation system of said route setting guide, said predetermined x,y coordinate system of said climbing wall being formed by a plurality of predetermined hand hold mounting apertures at interstices formed by said x, y coordinate system, each said climbing wall mounting position of said rigid climbing wall having attachment means therein to receive a hand hold structure, and to permit handhold rotation about each said hand hold mounting aperture, wherein said interstices of said x, y coordinate system of said climbing wall with respect to said mounting apertures correspond to said specified x, y coordinate positions of said route setting guide for identifying hand hold selection, mounting position and orientation;

c) a plurality of hand hold structures, each having a gripping surface and fastening means for securing the hand hold structure to said climbing wall at said mounting positions of said rigid climbing wall, said fastening means providing rotational movement of each said handhold structure with respect to said handhold mounting position aperture to orient said gripping surface of each said handhold, each said hand hold structure having a specified positioning indicia as shown in the route setting map of said route setting guide, said specified positioning indicia including a rotational position of said handhold structure with respect to said x,y coordinate position, said positioning indicia being related to said specified x, y positions of said route setting guide, and said x,y coordinate system of said climbing wall and wherein each said hand hold structure has a body structure with an exterior surface and wherein said specified positioning indicia is on said exterior surface of said hand hold body structure; and d) whereby said climbing path is created by selecting from said climbing route setting assembly individual handhold structures for placement on said climbing wall from said plurality of handhold structures by matching said indicia from said map of said route setting guide to the corresponding positioning indicia on the exterior surface of each handhold to thereby identify a specific hand hold to create a climbing path on said climbing wall, placing each said hand hold onto said climbing wall at said predetermined hand hold mounting aperture corresponding to the x,y coordinates shown on said map and rotating each said hand hold on said climbing wall according to said indicia of said route setting guide to thereby create a climbing path on said climbing wall as selected from said map of said route setting guide.

2. The assembly of claim 1, wherein said hand hold structures have a plurality of colors to indicate climbing difficulty and wherein said route setting guide includes a plurality of climbing routes, each said climbing route having varying climbing difficulty.

3. The assembly of claim 2, wherein said plurality of colors include the color green to designate a beginner climbing route, yellow to designate intermediate and red to designate an advanced climbing route and wherein said route setting guide designates beginner routes by a circle, an intermediate route by a square and an advanced climbing route by a diamond.

4. The assembly of claim 1, wherein said plurality of hand hold structures are provided in a set of hand holds wherein each said hand hold in said set has a different body structure and a different indicia.

5. The assembly of claim 1, wherein said positioning indicia includes a number identifier, a letter identifier and wherein said rotational position is a directional hand hold body positioning arrow.

6. The assembly of claim 1, wherein each said climbing wall mounting position has a T-nut fastening structure and wherein said fastening means to permit rotation of said hand hold structure is a bolt or a screw for threading cooperation with said T-nut fastening structure securing each hand hold structure to said climbing wall.

7. A method of arranging hand hold members on a climbing wall to create a climbing path comprising:

a) providing at least one set of hand holds, each said hand hold of the set having indicia means thereon and having a bore therein for receiving a fastener, wherein said indicia means identifies each hand hold as a particular handhold of its set and includes a handhold positioning identifier and a rotational position identifier for positioning each said hand hold on a climbing wall to form a climbing path;

b) providing a rigid climbing wall having spaced mounting apertures therein for receiving mounting fasteners to secure and mount each said hand hold to said climbing wall panel wherein said spaced mounting apertures are located on said climbing wall forming a grid pattern having x, y coordinates used to identify the positioning of each said hand hold from said set of hand holds to create a climbing path on said climbing wall;

c) providing a route setting guide having a map of said climbing wall, said map including a grid having x,y coordinates which show and designate and identify the locations of said mounting apertures in said climbing wall and to further show and designate the rotational direction for mounting each handhold with respect to said mounting apertures and wherein said map further includes and shows hand hold indicia which are located at predetermined locations on said grid coordinates of said map for replication on said climbing wall, wherein said hand hold indicia shown in said guide correspond to said indicia means of each said hand hold of said set of hand holds to identify predetermined hand holds to create a climbing path as shown in said route setting guide for positioning on said climbing wall;

d) selecting individual handholds for placement on said climbing wall from said set of handholds by matching indicia from said map of said route setting guide to the corresponding indicia means on each said handhold to thereby identify said predetermined hand holds to create a climbing path on said climbing wall;

e) placing and securing each said predetermined hand hold onto said climbing wall at each said predetermined x,y location mounting aperture of said climbing wall located and corresponding to the x,y coordinates provided and shown on said map;

f) positioning each said hand hold on said climbing wall according to said positioning identifier as set forth and shown in said route setting guide including setting the rotational orientation of each said handhold as shown and designated in said map of said route setting guide as provided in step c); and g) securing each said hand hold by tightening said fastener through said bore and in said mounting apertures of said climbing wall to thereby create a climbing path on said climbing wall as shown in said map of said route setting guide.

8. The method of claim 7, wherein said method further includes providing a scale and color guide in said guide.

9. The method of claim 7, wherein said method further includes providing handholds which are color coded to identify climbing difficulty.

10. The method of claim 7, wherein said indicia means of each said hand hold and said guide provided include a letter, a number and an arrow, wherein said letter corresponds to a predetermined set of handholds and wherein said arrow is said positioning identifier to indicate the rotational orientation of said handhold to thereby control the position of the gripping surface of said handhold.

11. The method of claim 7, wherein said guide indicia are provided in circle, square and diamond shapes and wherein each shape corresponds to a different difficulty level of climbing path.

12. The method of claim 11, wherein in the guide provided, circle handhold indicia depict easy, the square handhold indicia depict intermediate and the diamond hand hold indicia depict difficult.

13. The method of claim 9, wherein a plurality of hand hold sets are provided and wherein said sets of handholds are color coded green for easy, yellow for intermediate, red for difficult and blue for expert.

14. The method of claim 7, wherein said mounting fastener of said climbing wall provided is a single T-nut structure and wherein said handhold fastener is a single cooperating bolt structure.

15. A climbing wall route setting assembly comprising:

a) a rigid climbing wall having mounting apertures having embedded T-nut mounting means disposed therein, said mounting apertures defining an x,y grid of interstices to mount predetermined hand holds for creating a climbing path on said climbing wall;

b) at least one set of handholds, each hand hold having an aperture and fastening means held therein and extending through said aperture to engage said embedded T-nut mounting means and to secure each hand hold from said set of handholds to said climbing wall while allowing rotational positioning of each said handhold with respect to said fastening means and said climbing wall, and each handhold having an indicia located thereon, wherein said indicia includes a rotational positioning indicator and a handhold identification indicator to identify each said handhold as a predetermined hand hold member of a specified set of handholds, and further wherein said rotational positioning indicator is an arrow and said identification indicator is a combination of a letter and a number, said hand hold set for positioning each said hand hold at predetermined locations on said climbing wall at said x,y grid of interstices to create a climbing path;

c) a guide member having at least one map of said climbing wall, said guide member showing a grid and x,y coordinate system thereon which corresponds to said x,y grid of interstices of said climbing wall and which identifies the mounting apertures located on said climbing wall and which has x,y and rotational direction indicia located at predetermined mounting apertures which correspond to the identification and rotational positioning handhold indicia of each said hand hold to thereby identify the hand holds to create the climbing path and to thereby provide a map of a predetermined climbing path for said climbing wall;

d) whereby said predetermined climbing path is created by selecting individual handholds for placement on said climbing wall from said set of handholds by matching said x, y and rotational direction indicia from said map of said guide member to the corresponding hand hold identification indicator and rotational positioning indicator of each said handhold to thereby identify said predetermined hand holds, placing each said predetermined hand hold onto said climbing wall at each said predetermined mounting apertures of said climbing wall corresponding to the x,y coordinates shown on said map, positioning each said hand hold on said climbing wall according to said rotational direction indicia shown in said guide member and securing each said hand hold by tightening said fastener into said T-nut mounting means of said climbing wall to thereby create said predetermined climbing path on said climbing wall as shown in said map of said guide member.

16. The climbing wall route setting assembly of claim 15, wherein said at least one set of hand holds provided is color coded to identify the degree of climbing difficulty.

17. The climbing wall route setting assembly of claim 15, wherein said fastening means is selected from the group of fastening means comprising bolts, screws, nails, adhesives and combinations thereof.

18. The climbing wall route setting assembly of claim 15, wherein said indicia further includes a difficulty indicator, wherein a circle indicia depicts an easy climbing path, a square indicia depicts an intermediate climbing path and a diamond indicia depicts a difficult climbing path.

19. The climbing wall route setting assembly of claim 16, wherein said at least one set of hand holds is color coded green for easy, yellow for intermediate, red for difficult and blue for expert.

* * * * *